US008215921B2

(12) United States Patent
Coonrod

(10) Patent No.: US 8,215,921 B2
(45) Date of Patent: Jul. 10, 2012

(54) METHODS AND SYSTEMS FOR DEFOGGING TRANSPARENT DOORS IN DISPLAY CASES

(75) Inventor: Scott Coonrod, Ft. Wayne, IN (US)

(73) Assignee: RBC Manufacturing Corporation, Beloit, WI (US)

( * ) Notice: Subject to any disclaimer, the term of this patent is extended or adjusted under 35 U.S.C. 154(b) by 696 days.

(21) Appl. No.: 12/358,802

(22) Filed: Jan. 23, 2009

(65) Prior Publication Data

US 2010/0189571 A1 Jul. 29, 2010

(51) Int. Cl.
*F04B 49/06* (2006.01)

(52) U.S. Cl. ..... 417/45; 62/153

(58) Field of Classification Search ..... 417/44.1
See application file for complete search history.

(56) References Cited

U.S. PATENT DOCUMENTS

| | | | | |
|---|---|---|---|---|
| 4,361,012 | A | 11/1982 | Ibrahim | |
| 4,794,764 | A | 1/1989 | Dyment et al. | |
| 4,827,729 | A * | 5/1989 | Groth et al. | 62/80 |
| 4,977,754 | A | 12/1990 | Upton et al. | |
| 5,269,152 | A * | 12/1993 | Park | 62/89 |
| 6,112,546 | A * | 9/2000 | Kim | 62/440 |
| 6,155,060 | A * | 12/2000 | Parkman | 62/94 |
| 6,470,696 | B1 * | 10/2002 | Palfy et al. | 62/140 |
| 6,722,142 | B1 | 4/2004 | Pagel | |
| 7,003,920 | B1 | 2/2006 | Messere et al. | |
| 7,222,666 | B2 | 5/2007 | Homan et al. | |
| 7,461,551 | B2 | 12/2008 | Kataoka et al. | |
| 2004/0083748 | A1 | 5/2004 | Homan et al. | |
| 2005/0202178 | A1 | 9/2005 | Roche et al. | |
| 2006/0127586 | A1 | 6/2006 | Roche et al. | |
| 2007/0003700 | A1 | 1/2007 | Roche et al. | |

OTHER PUBLICATIONS

European Search Report and Written Opinion, EP 10275004 dated Feb. 17, 2011 (5 pages).

* cited by examiner

*Primary Examiner* — Peter Macchiarolo
(74) *Attorney, Agent, or Firm* — Armstrong Teasdale LLP

(57) ABSTRACT

A system for defogging doors to a display case is described and includes an electric motor and an air moving device. The air moving device is operatively coupled to the electric motor and positioned to provide an output proximate to at least one door of the display case. The motor is configured to operate at a first speed under standard closed door conditions, at a second speed when the door of the display case is open, and at a third speed for a predetermined length of time after the door is moved from an open position to a closed position.

20 Claims, 2 Drawing Sheets

METHODS AND SYSTEMS FOR DEFOGGING TRANSPARENT DOORS IN DISPLAY CASES

BACKGROUND OF THE INVENTION

The field of the invention relates generally to display cases, and more specifically, to methods and systems for defogging transparent doors in display cases.

In a transparent door display case, especially a display case that is refrigerated, energy efficiency and consumer product visibility are key. In order to persuade consumers to buy products, the vendors try to make the product visible to the consumer. Fog or condensation accumulated on a transparent door, for example, a door that is at least partially made of glass, may hide the product from the consumer. Hindering the consumer's view of the product may negatively affect the likelihood the consumer will buy the product.

When a transparent door display case has an open door, the evaporator fan tends to blow cold air to the outside of the case and allow warm air into the case. At least one result is that the refrigeration system must work harder to remove this heat and return the inside of the display case to the desired internal temperature. Additionally, if the air transitioned into the display case is of relatively high moisture content, faster icing of the evaporator coils is one possible result. As such, the refrigeration system must incorporate additional defrosting cycles. Defrosting cycles not only use energy, but they also add heat to the system that must be removed by refrigeration cycles.

One current technology for dealing with air exchange between the inside of a display case and the outside environment when a door is opened is an air curtain. One down side of an air curtain, however, is that complicated ductwork is required to generate a proper air curtain, reducing the amount of merchandise space. Providing an air curtain also increases the static loading on the evaporator fan. As such, a higher output motor that consumes more energy is required.

One alternative considered to prevent air exchange is to shut off the evaporator fan motor when the display case door is open. This solution results in additional wear on the motor and related electrical systems due to the constant cycling of motor contactors and motors repeatedly pulling inrush currents in response to the repeated opening and closing of the display case doors. Constantly turning on and off the evaporator fan motors can also create an audible annoyance to the consumer in terms of widely varying air noise.

Most existing technologies for removing fog/condensate from glass require applying heat in some form. Any heat added to the display case system requires the refrigeration system to work that much harder. The refrigeration compressor is the single largest consumer of energy in the display case system. Anti-fog glass can be effective in a wide range of operating conditions, but not all operating conditions. Adding extra airflow across the glass for a short period of time will help the anti-fog glass be more effective in a wider range of conditions. In some display case applications, blowing extra air may be just as effective with regular, lower cost glass as it is with the more expensive anti-fog glass.

BRIEF DESCRIPTION OF THE INVENTION

In one aspect, a system for defogging doors to a display case is provided. The system includes an electric motor and an air moving device operatively coupled to the electric motor. The air moving device is positioned to provide an output proximate to at least one door of the display case. The motor is configured to operate at a first speed under standard closed door conditions, at a second speed when the door of the display case is open, and at a third speed for a predetermined length of time after the door is moved from an open position to a closed position.

In another aspect, a method for controlling an operating speed of a motor configured to drive an air moving device is provided where the air moving device is configured to direct air along a planar surface of a door of a display case. The method includes operating the motor at a nominal operational speed under standard closed door conditions, operating the motor at an operational speed that is lower than the nominal operational speed when a sensor coupled to the motor indicates the door has been opened, and operating the motor at an operational speed that is higher than the nominal operational speed, for a predetermined period of time, when the sensor indicates the door has been closed.

In still another aspect a display case is provided. The display case includes a transparent door configured to provide access to an interior of the display case, an electric motor, an air moving device configured to be driven by the motor, and a sensor. The air moving device is configured to provide an airstream along a length of an interior of the transparent door. The sensor is operatively coupled to the motor. The sensor in a first state is indicative of the door being closed and configured to cause the motor to run at a nominal speed. The sensor in a second state is indicative of the door being open and configured to cause the motor to run at a speed lower than the nominal speed. The motor, upon sensing that the door has been closed, is configured to run at a speed higher than the nominal speed, for a predetermined length of time, after which the motor runs at the nominal speed.

DETAILED DESCRIPTION OF THE INVENTION

Figure 1:
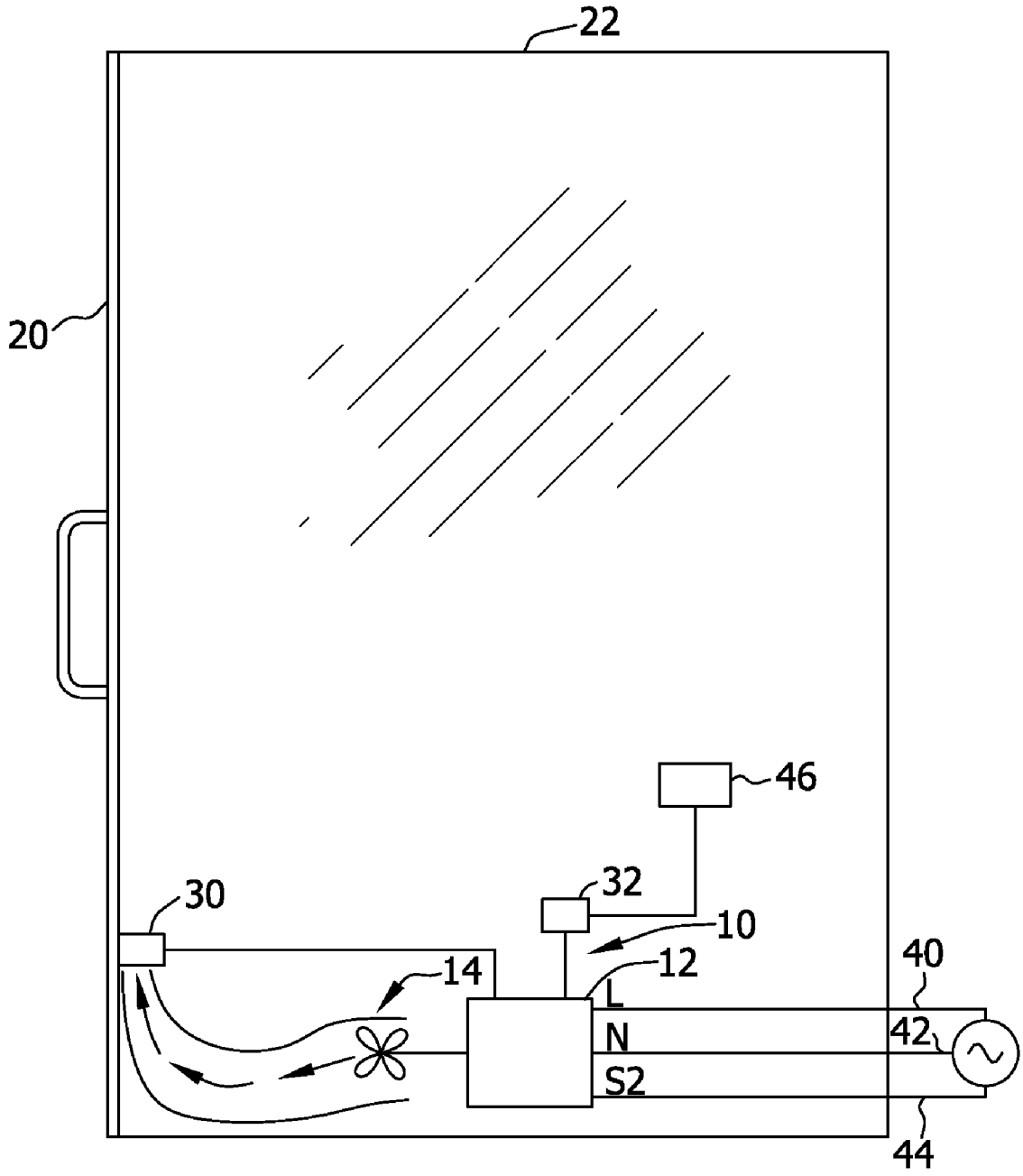
FIG. 1 is a block diagram of a display case including a door defogging system.

FIG. 1 is a block diagram of a display case door defogging system 10 that includes a motor 12 and an air moving device 14. In the exemplary embodiment, air moving device 14 is a fan and will be referred to herein as fan 14. However, air moving device 14 may include a fan, a blower, or any other device that allows defogging system 10 to function as described herein. Fan 14 is operatively connected to motor 12, and positioned to provide an output proximate to a glass door 20 of a display case 22. Although described herein as glass door 20, door 20 may include any transparent material that allows display case 22 to function as described herein. For example, door 20 may include a transparent section made from glass, plastic, acrylic glass, or any other substantially transparent material.

In the exemplary embodiment, defogging system 10 is configured such that motor 12 causes fan 14 to operate at a nominal operational speed under standard closed door conditions, to operate at a low operational speed when the door 20 of the display case 22 is open to minimize heat transference, and to operate at a higher than nominal speed for a predetermined length of time, shortly after the door 20 is closed, in order to timely remove accumulated fog and/or condensation from the door. In one embodiment, the length of time the motor 12 operates at the higher than nominal speed may be adjusted by the end user. In an exemplary embodiment, a door switch 30 or other door activated sensor is incorporated into system 10 to sense door position, and hence indirectly controls the operating speed of motor 12, and subsequently an amount of air output by fan 14. Switch 30 can operate a single motor or effect more than one motor in a display case 22. In an alternative embodiment, motor 12 may sense door open events automatically by, for example, drastic, substantially instantaneous changes in load.

In one embodiment, motor 12 is a multispeed induction motor operatively connected to switch 30 and further connected to an external timer 32. In another embodiment, motor 12 is a multispeed brushless DC (direct current) motor, also referred to herein as a multispeed ECM (electronically commutated motor), operatively connected to switch 30 and timer 32. In one embodiment, the timer 32 is built into the ECM, for example, within the electronics/software associated with the ECM. In at least one embodiment, the timer 32 is operable to control an amount of time the motor 12 operates at higher than nominal speed. In another embodiment, motor 12 is a multispeed ECM having a controller therein which includes electronics and any software that is necessary for load sensing and/or timing to minimize heat transference for maximum system efficiency and to clear fog on the door more quickly for improved product visibility.

The system 10 provides a method for using multiple motor operating points to improve application (e.g., display case) system efficiency and minimize fogging of the glass door so that product being displayed for sale remains visible to the consumer. Multiple operating points can be achieved in a variety of ways. For an induction motor, multiple operating points can be accomplished through multiple windings, winding taps, or using an electronics circuit operable to apply power to motor 12 and controlled through switch 30. Examples of such electronic circuits include a voltage chopper circuit and a variable frequency drive circuit.

For an ECM, multiple operating points may be achieved using electronics hardware and/or software inside the controller. As described above, there are three basic operating conditions: normal operation, low airflow, and high airflow. Normal operation is the standard operating mode for the application. In examples described herein, the standard operating mode for display case 22 includes motor 12 operating at a nominal speed. Low airflow operation is used when the door to the case is opened to minimize how much cold air from inside the case is exchanged with the warm air outside the case, thereby minimizing the work the refrigeration system has to do to maintain a desired temperature within the display case. High airflow operation is used when it is sensed that a door has recently been closed. The high airflow operation supplies an extra amount of air across the inside of the door to more quickly clear any fog or condensation that formed on the inside of the door when it was opened and exposed to warm, moist air that may be present in the ambient environment. The relatively quick defogging time associated with the high airflow operation is utilized to increase an amount of time the product inside the case is visible to a consumer through a clear display case door.

Objectives associated with the above described embodiments include providing a simple, low cost method to improve system efficiency while also maximizing merchandise visibility. As described, this can be done with different motor technologies and accessories. Embodiments that utilize an ECM are further described in the following paragraphs as they generally are equipped with the electronics needed to implement the described embodiments.

The electronics provided with an ECM motor system may be configured for multiple motor operating speeds by configuring those electronics to provide built in delays and/or timer transitions between operating points. In one embodiment, a simple door activated switch can be used to evoke different operating conditions, for example, different operating speeds. For more sophisticated models with known nominal parameters, the ECM is operable to automatically switch between operating speeds based on the load that is sensed, thereby eliminating the need for a door activated switch.

More specifically and in regard to the above mentioned ECM implementation, an ECM motor has three leads: Line (L) 40, Neutral (N) 42, and Speed2 (S2) 44. When a line voltage is applied between L 40 and N 42, motor 12 runs at the nominal operating point. An operating point is defined as an operating speed and direction of rotation. With line voltage applied between L 40 and N 42, if S2 44 is then shorted to N 42, the low airflow operating point is enacted. With line voltage applied between L 40 and N 42 and S2 44 shorted to N 42, if S2 44 is then removed from connection with N 42, motor 12 will run at the high airflow operating point for a predetermined length of time (T). In an exemplary embodiment, T is configured in the electronics/software associated with the ECM. Once T elapses, without any other changes, motor 12 will return to the nominal operating point. If at any point line voltage is removed, the motor will cease to operate. When power is reapplied between L 40 and N 42, the nominal operating point will resume unless S2 44 is shorted to N 42, in which case the low airflow operating point will be enacted.

In the display case application, these modes of operation are typically controlled with door-activated switch 30 (shown in FIG. 1). The switch 30 would be a normally closed switch and would connect between N 42 and S2 44, meaning that when the door 20 is closed, an actuator on switch 30 is depressed and the connection between N 42 and S2 44 is open. The motor 12 would be running at either the nominal operating point or the high airflow operating point depending on the previous operating state. When the door 20 is opened, the switch 30 resumes the normally closed state and shorts S2 44 to N 42. The low airflow operating point is then enacted.

In at least one embodiment, timer 32 is also operable to control a length of time motor 12 operates at the low airflow operating point. Timer 32 may be configured to monitor a length of time beginning when S2 44 is shorted to N 42 and motor 12 is operated at the low airflow operating point. If motor 12 is operating at the low airflow operating point for longer than a predetermined time (T2), motor 12 is directed to return to the nominal operating point, regardless of whether S2 44 remains shorted to N 42. Monitoring the time motor 12 operates at the low airflow operating point facilitates maintaining the temperature inside display case 22 and protecting products stored in display case 22 in the event door 20 is left in an open position for an extended period of time. In some embodiments, display case door defogging system 10 also includes an alarm system 46 that produces a signal when T2 is exceeded. In the exemplary embodiment, alarm system 46 activates an alarm to provide a notification to, for example, a store employee, that door 20 has been open for a period of time longer than T2. In an exemplary embodiment, door defogging system 10, and more specifically, timer 32, resumes normal operation once switch 30 is toggled.

Figure 2:
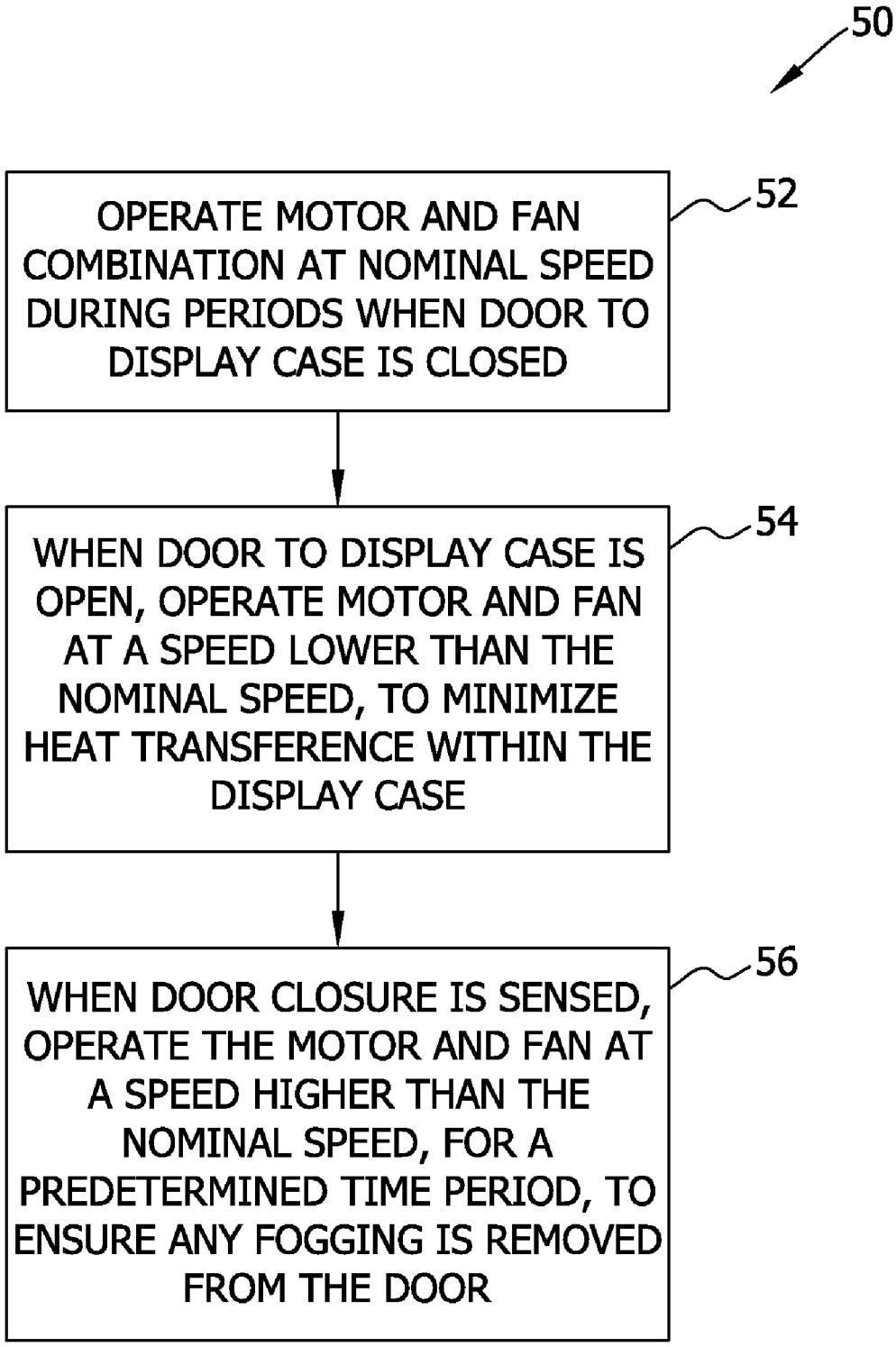
FIG. 2 is a flowchart illustrating a method for efficiently maintaining the clarity of a door for a display case.

FIG. 2 is a flowchart 50 illustrating a method for efficiently maintaining the clarity of a door for a display case. The method includes operating 52 the motor 12 (shown in FIG. 1) and thus the fan 14 (shown in FIG. 1) at a nominal operational speed under standard closed door conditions, that is, during periods when the door 20 to the display case 22 is closed. When the door 20 to the display case 22 is opened, the motor 12 and thus the fan 14, are configured to operate 54 at an operational speed that is lower than the nominal operational speed in order to minimize heat transference. When it is sensed that the door 20 to the display case 22 has been closed, the motor 12 and thus the fan 14 are configured to operate 56 at a speed higher than the nominal speed for a predetermined amount of time, shortly after the door 20 is closed, in order to timely remove fog and condensation from the door.

As described herein, using a high fan speed for a short period of time helps to clear fog more quickly, which maintains product visibility. Smaller transitions in motor speed are likely to be less noticeable by a consumer viewing and selecting items in a refrigerated display case.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system for defogging doors to a display case, said system comprising:

an electric motor; and an air moving device operatively coupled to said electric motor and positioned to provide an output proximate to at least one door of the display case, said motor configured to operate at a first speed under standard closed door conditions, at a second speed when the door of the display case is open, and at a third speed for a predetermined length of time after the door is moved from an open position to a closed position, wherein the second speed is slower than the first speed and the third speed is faster than the first speed.

2. A system according to claim 1 wherein the second speed reduces heat transference when compared to operating said motor at the first speed, and the third speed increases fog removal from the at least one glass door when compared to operating said motor at the first speed.

3. A system according to claim 1 wherein said electric motor comprises one of a multispeed induction motor and a multispeed electronically commutated motor.

4. A system according to claim 1 further comprising a sensor operable to determine whether the door is opened or closed, said sensor communicatively coupled to said electric motor to control the speed of the motor based on door position.

5. A system according to claim 4 wherein said sensor comprises a switch.

6. A system according to claim 4 comprising a plurality of motors and air moving devices, said sensor operable to control the speed of the plurality of motors based on door position.

7. A system according to claim 4 wherein said motor comprises an electronically commutated motor comprising a controller therein, said controller operable to set the speed of said motor based on a state of said sensor, said controller further configurable to control the length of time said motor operates at the third speed.

8. A system according to claim 1 wherein said motor is configured to sense that the door has opened or that the door has closed by automatically sensing substantially instantaneous changes in a load provided by said air moving device.

9. A system according to claim 1 further comprising a switch and an external timer, said switch operable to control the speed of said motor based on door position, said timer activated upon said switch sensing the door has been closed and further operable to control an amount of time said motor operates at the third speed.

10. A system according to claim 1 wherein said motor comprises an induction motor further comprising at least one of multiple windings, winding taps, a voltage chopper at a motor power input, and a variable frequency drive at the motor power input to achieve the first speed, the second speed, and the third speed.

11. A system according to claim 1 wherein the predetermined length of time is configurable by a user.

12. A method for controlling an operating speed of a motor configured to drive an air moving device, the air moving device configured to direct air along a planar surface of a door of a display case, said method comprising:

operating the motor at a nominal operational speed under standard closed door conditions;

operating the motor at an operational speed that is lower than the nominal operational speed when a sensor coupled to the motor indicates the door has been opened; and operating the motor at an operational speed that is higher than the nominal operational speed, for a predetermined period of time, when the sensor indicates the door has been closed.

13. A method according to claim 12 further comprising sensing that the door has been opened or that the door has been closed by automatically sensing substantially instantaneous changes in a load on the motor provided by the air moving device.

14. A method according to claim 12 wherein the sensor is a switch electrically coupled to the motor and mechanically coupled to the door.

15. A display case comprising:

a transparent door configured to provide access to an interior of said display case;

an electric motor;

an air moving device configured to be driven by said motor, said air moving device configured to provide an airstream along a length of an interior of said transparent door; and a sensor, said sensor operatively coupled to said motor, said sensor in a first state indicative of said door being closed and configured to cause said motor to run at a nominal speed, said sensor in a second state indicative of said door being open and configured to cause said motor to run at a speed lower than the nominal speed, said motor, upon sensing that said door has been closed, configured to run at a speed higher than the nominal speed, for a predetermined length of time, after which said motor runs at the nominal speed.

16. A display case according to claim 15 further comprising an external timer, said timer activated upon said sensor sensing said door has been closed, said timer further operable to control the length of time said motor operates at the speed higher than the nominal speed.

17. A display case according to claim 16 wherein said external timer is further operable to control a length of time said motor operates at the speed lower than the nominal speed to facilitate maintaining a temperature inside the display case if said transparent door remains open for an extended period of time.

18. A display case according to claim 15 wherein said electric motor comprises a multispeed electronically commutated motor.

19. A display case according to claim 18 wherein said electronically commutated motor comprises a controller therein, said controller operable to set the speed of said motor based on a state of said sensor, said controller further configurable to control the length of time said motor operates at the speed higher than the nominal speed.

20. A display case according to claim 15 wherein said sensor is associated with said motor such that the first state and the second state are achieved through sensing the changes in the load, due to a pressure change within said display case, provided by said air moving device when said door is opened or closed.

* * * * *